US005226485A

United States Patent [19]

Dobscha et al.

[11] Patent Number: 5,226,485

[45] Date of Patent: Jul. 13, 1993

[54] PASS-THROUGH ZONE ISOLATION PACKER AND PROCESS FOR ISOLATING ZONES IN A MULTIPLE-ZONE WELL

[75] Inventors: Francis X. Dobscha, Birmingham; Stephen W. Lambert, Northport; Jerrald L. Saulsberry, Hoover, all of Ala.

[73] Assignee: Gas Research Institute, Chicago, Ill.

[21] Appl. No.: 975,110

[22] Filed: Nov. 12, 1992

Related U.S. Application Data

[62] Division of Ser. No. 698,020, May 10, 1991, Pat. No. 5,184,677.

[51] Int. Cl.[5] ..... E21B 33/127; E21B 43/14

[52] U.S. Cl. ..... 166/387; 166/187

[58] Field of Search ..... 166/387, 187, 133, 183, 166/129, 189

[56] References Cited

U.S. PATENT DOCUMENTS

| | | | |
|---|---|---|---|
| 3,493,045 | 2/1970 | Bassani | 166/187 |
| 3,764,235 | 10/1973 | Bittermann | 166/187 X |
| 3,865,188 | 2/1975 | Doggett et al. | 166/187 X |
| 3,899,631 | 8/1975 | Clark | 166/187 X |
| 5,105,881 | 4/1992 | Thoms et al. | 166/187 X |

OTHER PUBLICATIONS

"Lynes Production-Injection Packer (PIP TM)", eleven pages, promotional literature (date unknown).

Rock Creek Methane from Multiple Coal Seams Completion Project, Annual Report, Jan. 1989-Dec. 1989, Gas Research Institute, 8600 W. Bryn Mawr Av., Chicago, Ill. 60631, pp. 244 and 250.

*Primary Examiner*—Terry Lee Melius

*Attorney, Agent, or Firm*—Speckman, Pauley & Fejer

[57] ABSTRACT

A pass-through zone isolation packer and process for isolating zones in a multiple-zone well. The pass-through zone isolation packer has an upper packer sub with an upper sub through hole and a lower packer sub with a lower sub through hole. A packer mandrel having a through bore is positioned through the upper sub through hole and the lower sub through hole. The upper packer sub and the lower packer sub are secured to the packer mandrel. A packer element is positioned between and is secured to the upper packer sub and the lower packer sub. Likewise, a packer bladder is positioned between the upper packer sub and the lower packer sub. The packer bladder is hermetically sealed to both the upper packer sub and the lower packer sub, so as to form a gas-tight annular gas chamber between the packer mandrel and the packer bladder. An inlet tube is used to introduce a pressurized gas through the upper packer sub and into the annular gas chamber. For the purpose of positioning at least one pass-through zone isolation packer above a dual zone isolation packer mounted within a multi-zone well, the pass-through zone isolation packer has a pass-through conduit which is routed through the upper packer sub, within the annular gas chamber and through the lower packer sub. The zone isolation packer devices are positioned in a well so that fluid flow between, above and below each device can be measured by selectively inflating and deflating packer bladders and measuring differences in gas flows from one configuration to another.

8 Claims, 3 Drawing Sheets

PASS-THROUGH ZONE ISOLATION PACKER AND PROCESS FOR ISOLATING ZONES IN A MULTIPLE-ZONE WELL

This is a divisional of co-pending U.S. patent application having Ser. No. 07/698,020, filed May 10, 1991, now U.S. Pat. No. 5,184,677.

SUMMARY OF THE INVENTION

1. Field of the Invention

This invention relates to a pass-through zone isolation packer apparatus for isolating zones in a multiple-zone well, and to a process for positioning at least one pass-through zone isolation packer and preferably a dual zone isolation packer within the multiple-zone well for selectively measuring fluid flow from the corresponding measured gas production zones.

2. Description of Prior Art

Many coalbed methane wells are completed in multiple seams. In such wells, production is usually commingled so that only total gas and water rates are known. There are several advantages for being able to determine the production from each completed coal group. For example, knowing the production data from each completed coal group allows certain zones producing at such relatively low rates to be identified so that a determination can be made whether to pursue stimulation of such zones in planned wells. Another advantage is that production problems and remedial treatments can be identified for specific zones. Furthermore, by knowing production by zone, reservoir simulation history-matches may be improved. This will allow more accurate determination of optimum well spacing and stimulation design.

A bridge-plug method represents conventional technology for determining the production data of certain coal groups. According to the bridge-plug method, a production rate from a bottom or lower zone of a well is determined by measuring the total production rate without the bridge plug inserted into the well and then inserting the bridge plug to isolate the top zone from the bottom zone. The production rate of the top zone is measured and then subtracted from the total production rate to obtain a calculated production rate for the bottom zone. It is important that flow rates, with and without the bridge plug, are stabilized at the same bottom-hole pressure, in order to obtain comparable production data. However, during the early life of a well, when production rates are rapidly changing, stabilized rates are often difficult to achieve. One advantage of the bridge-plug method is direct measurement of gas and water production rates from the upper zones. However, one major disadvantage of the bridge-plug method is that it is relatively expensive, and production rates are determined only one time and then the bridge plug device is physically removed from the well.

A water-analysis method also represents conventional technology for determining production rates from multiple-zone wells. Although the water-analysis method is relatively simple and low-cost, such method has several disadvantages. The water-analysis method requires an adequate database of water analyses. Correlations that work well in one particular geographical area often fail in other geographical areas. The water-analysis method is reliable only in areas where coal zones produce water with distinctive total dissolved solids (TDS) levels. Estimates of water production by each zone must be based on several tests per well in order to minimize errors due to fluctuations in water composition.

Conventional anchor casing packer elements, such as a Production-Injection Packer (PIP TM) which is manufactured by Lynes, Inc., are commonly inserted into a well in order to determine production rates from zones within multiple-zone wells. With such packer element, an inflatable packer element expands when a pressured gas is injected into an inner chamber of the device. The packer element then seals against an inner surface of a casing wall of the multiple-zone well. The total production rate for the multiple-zone well is determined without the conventional packer element positioned within the well. The packer element is then lowered to various positions so as to isolate a first zone, then is further lowered to isolate a combination of the first zone and a second zone. The packer is then sequentially lowered to different depths within the well in order to determine production rates from various sequential combinations of the zones. Simple arithmetic is then used to determine the production rate associated with each specific zone. Although this method of determining the production rates is effective, such method is also labor, time and equipment intensive since a rigging device must be positioned at the opening of the well each time the packer element is either removed from or lowered to different depths or levels within the multiple-zone well. Another disadvantage of such method is the fact that once the production rate of each specific zone has been determined, the conventional packer element must be physically removed from within the well in order to resume fluid flow operations from the multiple-zone well. During the test period, yet another disadvantage of using the PIP TM, is that the withdrawal of water produced by the formation or formations is interrupted thereby reducing gas production during the test period. The conventional packer elements must be removed from the well since the maximum outside diameter of each such packer element is so great that the packer element can restrict fluid flow during normal removal operations.

SUMMARY OF THE INVENTION

It is thus one object of this invention to provide a pass-through zone isolation packer (ZIP) which can be positioned within a multiple-zone well and which can remain positioned within that particular well during normal operations of the well, without substantially restricting normal fluid flow from the multiple zones to the well.

It is another object of this invention to use at least one pass-through ZIP, preferably in combination with a dual ZIP, in order to selectively measure production rates from more than two production zones.

It is yet another object of this invention to develop technology for providing a more cost-effective process for determining the production rates associated with each specific zone of a multiple-zone well, particularly wells producing methane from shallow multiple coal seams using single vertical wellbores.

The above objects of this invention are accomplished with a pass-through ZIP for isolating zones in a multiple-zone well, wherein the pass-through ZIP has an upper packer sub which forms an upper through hole and a lower packer sub which forms a lower through hole. One elongated packer mandrel is positioned within the upper through hole of the upper packer sub and within the lower through hole of the lower packer sub. The packer mandrel has a through bore extending the entire length of the packer mandrel. The upper packer sub and the lower packer sub are secured to the packer mandrel, preferably by a welded connection.

According to one preferred embodiment of this invention, a packer element is positioned between and is secured to the upper packer sub and the lower packer sub. A packer bladder is positioned between the upper packer sub and the lower packer sub, which are spaced along the packer at a specified distance from each other. The packer bladder has an upper end portion which is hermetically sealed about a bladder upper peripheral surface, or a shoulder surface, of the upper packer sub. An opposite lower end portion of the packer bladder is hermetically sealed about a bladder lower peripheral surface, or a shoulder surface, of the lower packer sub. The packer bladder preferably forms a gas-tight annular gas chamber between the bladder and the packer mandrel.

A fluid supply inlet conduit is used to introduce pressurized gas or hydraulic oil into the annular gas chamber, and thus expand the packer element. A pass-through conduit is routed through both the upper packer sub and the lower packer sub. Between the upper packer sub and the lower packer sub, the pass-through conduit is positioned within the annular gas chamber. In one preferred embodiment according to this invention, the pass-through conduit is mounted adjacent to an outside surface of the packer mandrel. In another preferred embodiment according to this invention, the pass-through conduit is mounted within a corresponding groove cut within the outside surface of the packer mandrel. It is apparent that more than one pass through conduit can be routed through the pass-through ZIP.

The upper end portion as well as the lower end portion of either the packer element or the packer bladder can be secured to the corresponding upper packer sub or lower packer sub with a vulcanized connection, or with any other suitable connection between the preferably elastomeric material of the packer bladder, or the packer element, and the preferably metal material of either the upper packer sub or the lower packer sub.

The packer mandrel is secured in-line with a rigid conduit, such as a conventional water conduit commonly used within vertical wells. It is an important aspect of this invention for the inner diameter of the packer mandrel to equal the inner diameter of the rigid water conduit, so that a down-hole plunger pump can operate through the packer mandrel of the pass-through ZIP.

The pass-through ZIP also has an inlet for the pressurized gas or liquid which is supplied to the annular gas chamber defined by the packer bladder. In one preferred embodiment according to this invention, the gas inlet includes the packer sub having or forming a gas passage which is in communication with the annular gas chamber. An inlet conduit is secured to the upper packer sub, by any suitable securing method familiar to those skilled in the art. The inlet conduit is in communication with the gas passage. An inlet compression fitting can be used to secure the inlet conduit to the upper packer sub. Also, an inlet compression fitting can be used to secure a stub end of the inlet conduit to a gas supply conduit or tubing which is routed down the well and attached at specified intervals adjacent the rigid tubing. The rigid tubing is commonly used to withdraw water from the well. In another preferred embodiment according to this invention, the pass-through conduit is welded to the upper packer sub and to the lower packer sub. The pass-through conduit is routed through or positioned within the annular gas chamber.

In another preferred embodiment according to this invention, the pass-through conduit forms an upper conduit stub which projects outward from a upper outside surface of the upper packer sub. Such pass-through conduit also forms a lower conduit stub which projects outward from a lower outside surface of the lower packer sub.

It is apparent that multiple pass-through ZIP devices can be positioned at different levels, preferably between two sequential zones, within a multi-zone well. For example, a dual ZIP can be positioned at a bottom or lower portion of the well, above the lowest or a relatively lower zone, and two or more pass-through ZIP devices can be positioned in a serial fashion at various specified levels, preferably above relatively higher zones, within the well. According to such embodiment of this invention, the uppermost pass-through ZIP will have a gas supply line feeding the packer bladder of the upper most pass-through ZIP, as well as one pass-through conduit for each pass-through ZIP and the dual ZIP positioned within the well, below the uppermost pass-through ZIP.

A process for performing zone isolation operations in a multiple-zone well begins with positioning a dual ZIP device within a bottom or lower portion of the multiple-zone well, preferably above the lowest zone. At least one pass-through ZIP is then positioned above the dual ZIP, within the multiple-zone well. The dual ZIP and all of the pass-through ZIP devices are preferably positioned between two or more production zones. Each pass-through ZIP device and the dual ZIP device are selectively inflated. The fluid flow through the well is then measured to determine the production rates from corresponding measured zones. When the measurement procedures are complete, all of the inflated packer bladders are deflated. It is an important aspect that the pass-through ZIP devices and the dual ZIP devices of this invention are maintained in their respective positions within the multiple-zone well, without significantly restricting normal fluid flow from the selected production zones.

When the packer bladders are inflated with the pressurized gas, the packer element of either the dual ZIP or the pass-through ZIP expands and forms a seal against an inner wall surface of a casing within the multiple-zone well. When the packer bladder is deflated, the pass-through ZIP and the dual ZIP are reduced to a minimum diameter which allows substantially normal fluid flow from each zone of the multiple-zone well, through the annular space between an I.D. of the casing and an O.D. of the deflated packer element.

BRIEF DESCRIPTION OF THE DRAWINGS

Further features of this invention will be apparent from the following more detailed description taken in conjunction with the drawings wherein.

DESCRIPTION OF PREFERRED EMBODIMENTS

Figure 1:
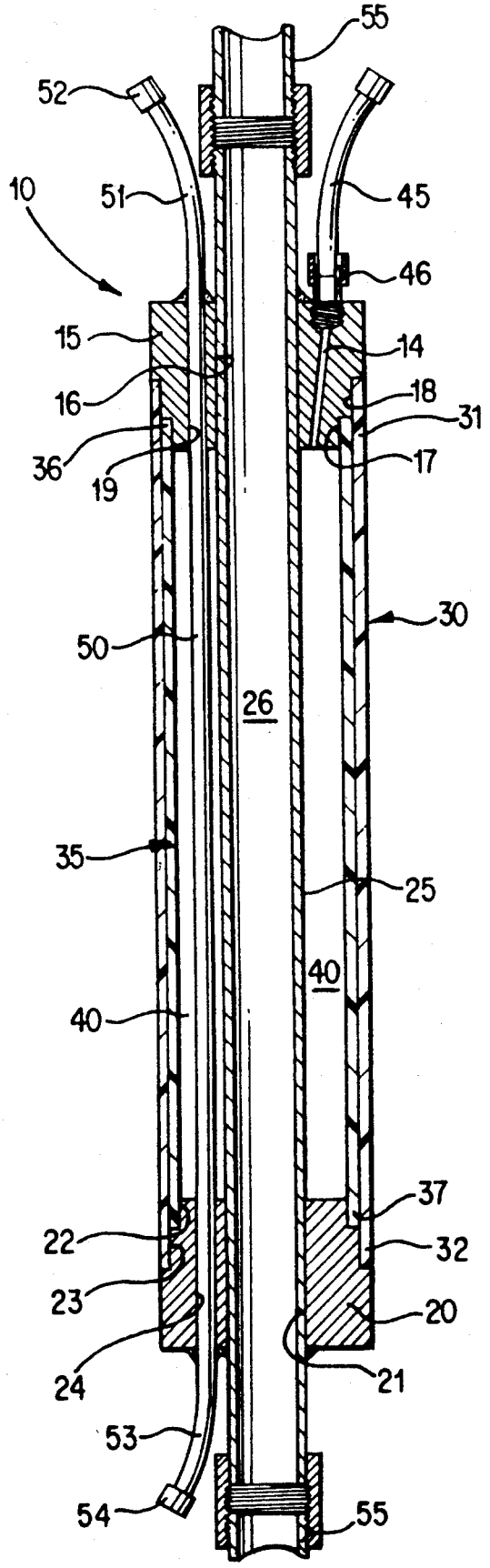
FIG. 1 is a partial cross-sectional front view of a pass-through zone isolation packer, according to one preferred, embodiment of this invention.
Figure 1A:
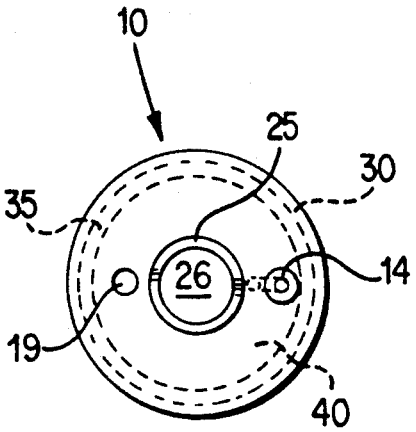
FIG. 1A is atop view of the pass-through zone isolation packer, as shown in FIG. 1 but without the inlet conduit and the upper conduit stub shown.
Figure 2A:
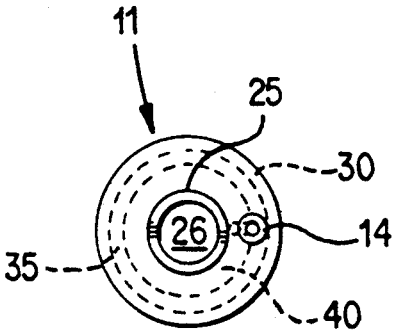
FIG. 2A is a top view of the dual zone isolation packer, as shown in FIG. 2 but without the inlet conduit shown.
Figure 4A:
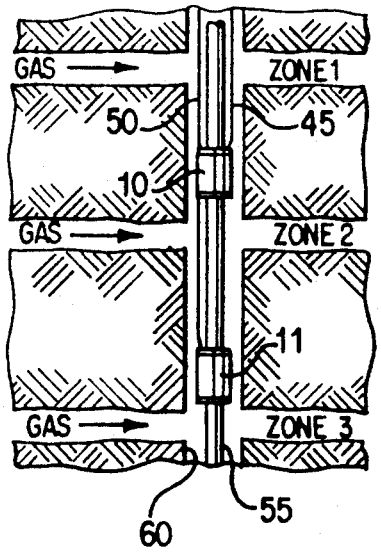
FIG. 4A is a diagrammatic view of a pass-through zone isolation packer and a dual zone isolation packer, with each zone isolation packer in a deflated state; 30
Figure 4B:
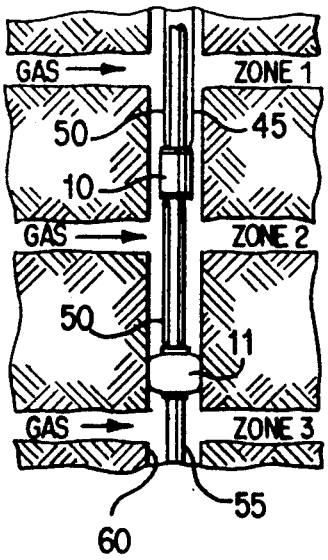
FIG. 4B is a diagrammatic view as shown in FIG. 4A but with only the dual zone isolation packer inflated.
Figure 4C:
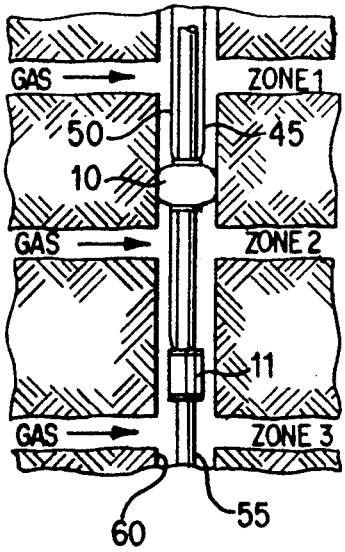
FIG. 4C is a diagrammatic view as shown in FIG. 4A but with only the pass-through zone isolation packer inflated.

Referring to FIG. 1 and 1A pass-through zone isolation packer (ZIP) 10 is shown mounted in-line with water conduit 55. Water conduit 55 is a conventional tube or pipe used to remove water from the bottom portion of a gas producing underground well. Water conduit 55 is commonly constructed of $2\frac{7}{8}''$ O.D. $2\frac{3}{8}''$ I.D. tubing. Pass-through ZIP 10 is best suited for use in a multiple-zone well, as shown in 15 FIGS. 4A–4C. The pass-through design of pass-through ZIP 10, according to this invention, enables the zone isolation packers to be permanently positioned within the multiple-zone well. By the term "permanent" or "permanently", as used throughout this specification and in the claims, it is intended to relate to maintaining the zone isolation packers in a mounted position within the well during normal well operations.

Throughout the specification and claims, pass-through ZIP 10 is differentiated from dual ZIP 11 in that dual ZIP 11 is typically placed at a bottom or lower portion of the multiple-zone well, since no further ZIP is located deeper in the well than dual ZIP 11. It is apparent that only multiple pass-through ZIP 10 devices can be used in lieu of one lowermost dual ZIP 11 and one or more pass-through ZIP 10 devices serially positioned above the single dual ZIP 11. If only pass-through ZIP 10 devices are positioned within the well, then the lowermost pass-through ZIP 10 would preferably have lower conduit stub 53 capped to prevent the pressurized gas from escaping into the well. However, it is preferred that the lowermost ZIP is a dual ZIP 11. The arrangement with the lowermost ZIP as a dual ZIP 11 may result in the most economical approach to zone isolation within a multiple-zone well.

In one preferred embodiment according to this invention, pass-through ZIP 10 comprises upper packer sub 15 which has upper through hole 16, and further comprises lower packer sub 20 which has lower through hole 21. Packer mandrel 25 is positioned within upper through hole 16 and within lower through hole 21. Upper packer sub 15 and lower packer sub 20 are secured to packer mandrel 25. Upper packer sub 15 and lower packer sub 20 are preferably welded to packer mandrel 25; however, it is apparent that other securing methods such as a threaded connection or an integrally formed piece or the like can be used to secure either upper packer sub 15 or lower packer sub 20 to packer mandrel 25.

Figure 2:
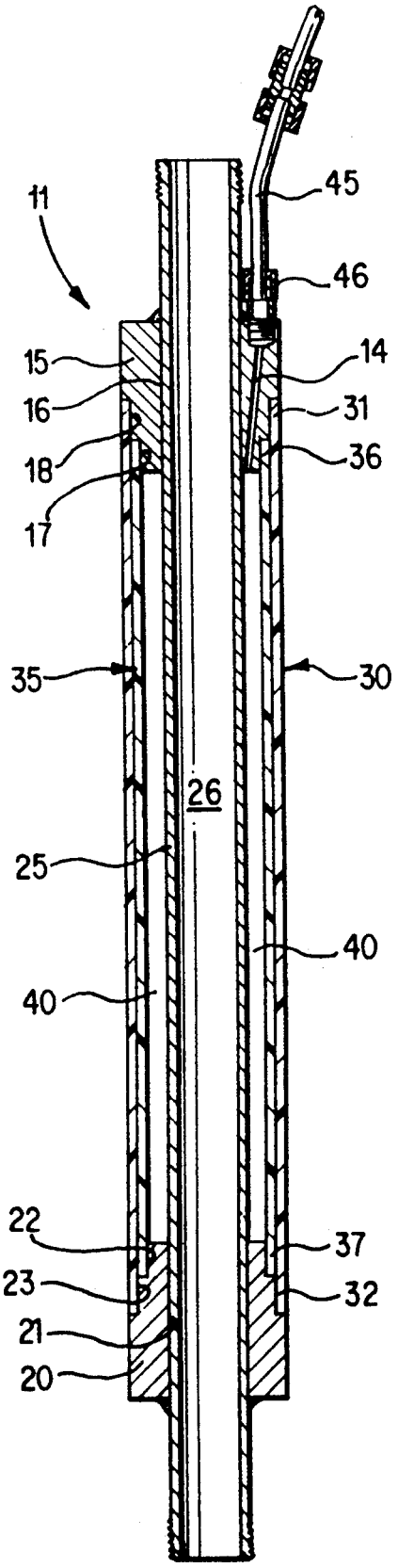
FIG. 2 is a partial cross-sectional view of a dual zone isolation packer, according to one preferred embodiment of this invention.

Packer element 30 is positioned between and is secured to upper packer sub 15 and lower packer sub 20. Packer bladder 35 is positioned between upper packer sub 15 and lower packer sub 20. According to one preferred embodiment of this invention, packer bladder 35 has upper end portion 36 hermetically sealed about upper peripheral surface 18 of upper packer sub 15. An opposite lower end portion 37 of packer bladder 35 is hermetically sealed about lower peripheral surface 22 of lower packer sub 20. Such arrangement of packer bladder 35 forms a gas-tight annular gas chamber between an outside surface of packer mandrel 25 and an inside surface of packer bladder 35. In one preferred embodiment according to this invention, upper end portion 31 and lower end portion 32 of packer element 30, as well as upper end portion 36 and lower end portion 37 of packer bladder 35 are preferably vulcanized to upper peripheral surface 18, lower peripheral surface 23, upper peripheral surface 17 and lower peripheral surface 22, respectively. It is apparent that such peripheral surfaces can be constructed as shown in FIGS. 1 and 2 or can be constructed as any other suitably shaped peripheral surface or shoulder surface.

Figure 5A:
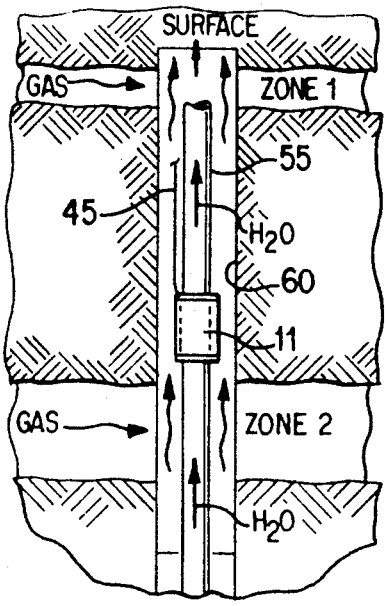
FIG. 5A is a diagrammatic view of a zone isolation packer in a deflated state.
Figure 5B:
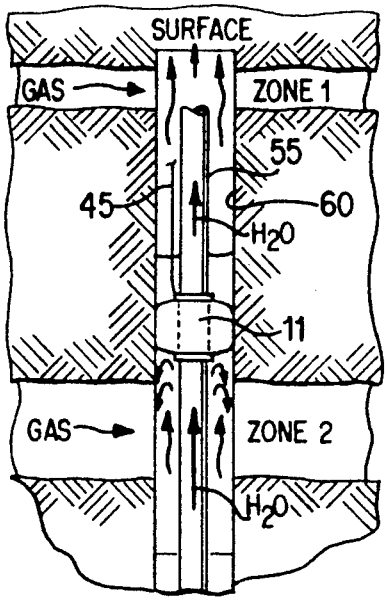
FIG. 5B is a diagrammatic view of a zone isolation packer in an inflated state.

Inlet means are used to introduce a pressurized gas, preferably nitrogen, into annular gas chamber 40. Packer bladder 35 and packer element 30 are preferably constructed of an elastomeric material, or any other suitable, expandable material having sufficient strength for the intended operating conditions. Introducing the pressurized gas within annular gas chamber 40 results in forces which push both packer bladder 35 and thus packer element 30 outward, as illustrated in FIG. 5B. The deflated state of dual ZIP 11 is shown in FIG. 5A. In one preferred embodiment according to this invention, the inlet means comprise upper packer sub 15 having gas passage 14 which is in communication with annular gas chamber 40. Inlet conduit 45 is in communication with gas passage 14. According to another preferred embodiment of this invention, inlet conduit 45 is secured to upper packer sub 15 with inlet compression fitting 46, as shown in FIG. 1. It is apparent that inlet conduit 45 can be welded to upper packer sub 15 or can be secured by any other suitable method.

In another preferred embodiment according to this invention, pass-through means for passing pass-through conduit 50 through upper packer sub 15 comprise upper packer sub 15 having at least one upper conduit through bore 19 and lower packer sub 20 having at least one lower conduit through bore 24. At least one pass-through conduit 50 is preferably routed through or within annular gas chamber 40, as shown in FIG. 1, and through lower conduit through bore 24. It is apparent that the number of pass-through conduits 50 able to be routed through pass-through ZIP 10 is only limited by the designed space of annular gas chamber 40.

Figure 3:
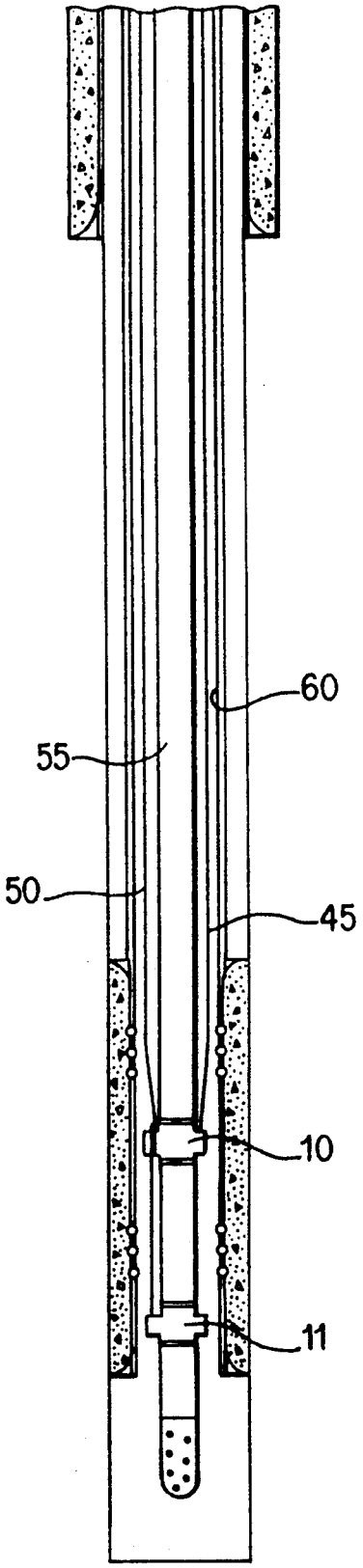
FIG. 3 is a schematic view of a pass-through zone isolation packer and a dual zone isolation packer positioned 25 within a multiple-zone well, according to another preferred embodiment of this invention.

In one preferred embodiment according to this invention, pass-through conduit 50 is welded to upper packer sub 15 and to lower packer sub 20. Each pass-through conduit 50 preferably projects outward from an upper outside surface of upper packer sub 15, as upper conduit stub 51. Each pass-through conduit 50 also preferably projects outward from a lower outside surface of lower packer sub 20, as lower conduit stub 53. The stubbed arrangement of pass-through conduit 50 is primarily for the purpose of allowing pass-through ZIP 10 to be manufactured, shipped and handled without a burdensome amount of tubing or conduit extending outward from upper packer sub 15 or from lower packer sub 20. In another preferred embodiment according to this invention, upper compression fitting 52 and lower compression fitting 54, as shown in FIG. 1, are used to connect the stubbed tubing to the gas feed tubing which is routed within casing 60 of the well, as shown in FIG. 3. When pass-through conduit 50 is positioned within annular gas chamber 40, pass-through conduit 50 is preferably mounted or secured adjacent packer mandrel 25. In another preferred embodiment according to this invention, pass-through conduit 50 is secured within a corresponding groove cut into an outside surface of packer mandrel 25. However, pass-through conduit can also be positioned at a distance from packer mandrel 25, as shown in FIG. 1. Inlet conduit 45 and pass-through conduit 50 can be ¼" stainless steel tubing or any other suitable tubing or conduit.

Packer mandrel 25 can be secured in-line with water conduit 55 by any suitable securement means known to those skilled in the art. For example, as shown in FIG. 1, packer mandrel 25 has externally threaded end portions for mating with an internally threaded coupling. However, it is apparent that other connection means, such as welding and the like can be used. It is an important aspect of this invention for packer mandrel 25 to have an inner diameter of through bore 26 equal to the inner diameter of water conduit 55. Such constant inner diameter allows a down-hole plunger pump to operate within water conduit 55.

In a process according to one preferred embodiment of this invention, performing zone isolation operations in the multiple-zone well begins with positioning dual ZIP 11 within a bottom or lower portion of the multiple-zone well, as shown in FIG. 3. At least one pass-through ZIP 10 is then positioned above dual ZIP 11, in a serial fashion within the multiple-zone well. The lowermost ZIP does not have to be positioned between the lowermost zone and the next higher zone, but such arrangement is most commonly set up. Each ZIP device is preferably positioned between sequential zones of the well, for apparent zone isolation purposes.

At least one packer bladder 35 of dual ZIP 11 and/or each corresponding pass-through ZIP 10 device is selectively inflated to isolate a particular zone or zones of the well. Fluid flow from the selected zone or zones is then measured according to conventional technology. After the measurement operations are complete, all of the inflated packer bladders 35 are deflated when normal well operations resume.

It is important to note that unlike conventional bridge-plug methods, when normal fluid removal operations from the multiple-zone well resume, dual ZIP 11 and/or all pass-through ZIP 10 devices are maintained within the well, in their respective positions. The ZIP devices are designed so that a maximum diameter, in a deflated state, does not cause a flow restriction which would significantly reduce the available and normal flow of the gases from the well. The decreased overall diameter of the ZIP device is accomplished by eliminating overlapping woven steel straps which are commonly molded into conventional packer elements. Eliminating such steel reinforcing from the packer elements also results in a packer element that can expand more than conventional packer elements. Thus, a lesser differential pressure between the pressure within annular gas chamber 40 and the pressure within casing 60 is required. Furthermore, without the steel reinforcing, packer element 30 according to this invention is more pliable and thus can form a better seal against an inside surface of casing 60, when the ZIP is inflated.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A process for performing zone isolation operations in a multiple-zone well, including the steps of:

(a) positioning a dual zone isolation packer device within a lower portion of the multiple-zone well;

(b) positioning at least one pass-through zone isolation packer device within the multiple-zone well, above said dual zone isolation packer device and between at least two zones;

(c) selectively inflating at least one packer bladder of at least one of said dual zone isolation packer device and said at least one pass-through zone isolation packer device;

(d) measuring fluid flow from at least one zone of the multiple-zone well;

(e) deflating all inflated packer bladders; and (f) maintaining said dual zone isolation packer device and each said pass-through zone isolation packer device as positioned within the multiple-zone well during normal fluid removal operations from the multiple-zone well.

2. A process according to claim 1 wherein at least one gas supply pass-through conduit is routed through each said pass-through zone isolation packer device.

3. A process according to claim 1, wherein after inflation of each said packer bladder a packer element is sealed against an inner wall surface of a casing of the multiple-zone well.

4. A process according to claim 1 wherein a maximum diameter of each of said dual zone isolation packer device and each said pass-through zone isolation packer device is reduced after the measuring of fluid flow to allow normal fluid flow from each zone of the multiple-zone well through a casing of the multiple-zone well.

5. A process for performing zone isolation operations in a multiple-zone well, including the steps of:

(a) positioning a first pass-through zone isolation packer device within a lower portion of the multiple-zone well;

(b) positioning at least one second pass-through zone isolation packer device within the multiple-zone well, above said first pass-through zone isolation packer device and between at least two zones;

(c) selectively inflating at least one packer bladder of at least one of said first pass-through zone isolation packer device and said at least one second pass-through zone isolation packer device;

(d) measuring fluid flow from at least one zone of the multiple-zone well;

(e) deflating all inflated packer bladders; and (f) maintaining said first pass-through zone isolation packer device and each said second pass-through zone isolation packer device as positioned within the multiple-zone well during normal fluid removal operations from the multiple-zone well.

6. A process according to claim 5 wherein at least one gas supply pass-through conduit is routed through each said second pass-through zone isolation packer device.

7. A process according to claim 5 wherein after inflation of each said packer bladder a packer element is sealed against an inner wall surface of a casing of the multiple-zone well.

8. A process according to claim 5 wherein a maximum diameter of each of said first pass-through zone isolation packer device and each said second pass-through zone isolation packer device is reduced after the measuring of fluid flow to allow normal fluid flow from each zone of the multiple-zone well through a casing of the multiple-zone well.

* * * * *